US006902245B1

(12) United States Patent
Hoeppner

(10) Patent No.: US 6,902,245 B1
(45) **Date of Patent: *Jun. 7, 2005**

(54) DRAWER SLIDE

(75) Inventor: Daniel M. Hoeppner, Warsaw, IN (US)

(73) Assignee: Grace Manufacturing, Inc., Warsaw, IN (US)

( * ) Notice: Subject to any disclaimer, the term of this patent is extended or adjusted under 35 U.S.C. 154(b) by 58 days.

This patent is subject to a terminal disclaimer.

(21) Appl. No.: 10/335,449

(22) Filed: Dec. 31, 2002

Related U.S. Application Data

(63) Continuation-in-part of application No. 09/818,319, filed on Mar. 27, 2001, now Pat. No. 6,499,819.

(51) Int. Cl.[7] ..... A47B 88/00
(52) U.S. Cl. ..... 312/334.46; 312/333; 312/334.44
(58) Field of Search ..... 312/334.44, 333, 312/334.46, 334.8, 334.34, 334.27, 334.32, 312/334.29; 384/21, 23

(56) References Cited

U.S. PATENT DOCUMENTS

| | | | | |
|---|---|---|---|---|
| 1,558,506 | A | 10/1925 | Riek | |
| 1,622,422 | A | 3/1927 | Conwell et al. | |
| 2,487,507 | A | 11/1949 | Zalkind | |
| 3,033,639 | A | 5/1962 | Emery | |
| 3,371,968 | A | 3/1968 | Loake | |
| 3,722,975 | A | 3/1973 | Taylor | |
| 3,876,270 | A | 4/1975 | White | |
| 4,061,375 | A | 12/1977 | Mertes | |
| 4,272,139 | A | 6/1981 | Fler | |
| 4,305,625 | A | 12/1981 | Gutner et al. | |
| 4,376,555 | A | 3/1983 | Grass | |
| 4,387,942 | A | 6/1983 | Lense | |
| 4,501,453 | A | 2/1985 | Gutner et al. | |
| 4,765,699 | A | 8/1988 | Bessinger et al. | |
| 4,872,734 | A | 10/1989 | Rechberg | |
| 5,046,861 | A | 9/1991 | Tarver | |
| 5,056,879 | A | 10/1991 | Rock et al. | |
| 5,244,272 | A | 9/1993 | Thompson | |
| 5,248,195 | A | 9/1993 | Shin | |
| 5,350,229 | A | 9/1994 | Smed | |
| 5,403,097 | A | 4/1995 | Woof | |
| 5,421,653 | A | 6/1995 | Triplette | |
| 5,671,988 | A | 9/1997 | O'Neill | |
| 6,076,906 | A | 6/2000 | Royal | |
| 6,499,819 | B2 * | 12/2002 | Hoeppner | 312/334.44 |
| 6,685,288 | B1 * | 2/2004 | MacMillan | 312/334.46 |

FOREIGN PATENT DOCUMENTS

| | | |
|---|---|---|
| DE | 26 45 667 | 4/1978 |

* cited by examiner

*Primary Examiner*—Janet M. Wilkens
(74) *Attorney, Agent, or Firm*—Barnes & Thornburg LLP

(57) ABSTRACT

A slide assembly for a drawer to be received in a frame has a drawer rail formed to include a rigid stop for attachment to the drawer, a frame rail for attachment to the frame, a bearing for receipt in the frame rail and for receiving the drawer rail slidably therein. The bearing includes a flexible stop which limits outward movement of the drawer rail by engaging the rigid stop when the flexible stop is in a first position and permits outward movement of the drawer rail when in a second deformed position.

20 Claims, 11 Drawing Sheets

DRAWER SLIDE

CROSS-REFERENCE TO RELATED APPLICATIONS

This application is a continuation-in-part of U.S. application Ser. No. 09/818,319, filed Mar. 27, 2001 now U.S. Pat. No. 6,499,819 and as such claims priority to such co-pending application as to the matters disclosed therein.

BACKGROUND AND SUMMARY

This invention relates generally to drawer slides. More particularly, this invention relates to drawer slides having a rail mounted to a drawer, a rail mounted to a frame, a bearing mounting the drawer rail to the frame rail for longitudinal reciprocal movement of the drawer rail relative to the frame rail, and a rigid stop and flexible stop cooperating to limit outward movement of the drawer rail relative to the frame rail under normal forces, the flexible stop being configured to deform sufficiently to permit passage of the rigid stop thereby under higher forces to permit further outward movement of the drawer rail relative to the frame rail.

Drawer slides are known having components or rails for attachment to a drawer and components or rails for attachment to a frame within which the drawer is to be received. Often such drawer slides include retention and release mechanisms that retain the drawer component within the frame component or vice versa until the release mechanism is actuated. Often retention release means are difficult to operate or of complicated manufacture.

The drawer slide assembly disclosed herein is easily operable and of simple manufacture. The disclosed drawer slide assembly includes a drawer rail, a frame rail and a bearing. The bearing is configured to couple the drawer rail to the frame rail to permit longitudinal reciprocal movement of the drawer rail relative to the frame rail. The drawer assembly includes a rigid stop and a flexible stop configured to cooperate to limit outward movement of the drawer rail relative to the frame rail under a force. In the illustrated embodiment, the rigid stop is formed in the drawer rail and the flexible stop is formed in the bearing. The deformable stop is configured to deform under higher longitudinal forces to permit passage of the rigid stop thereby and further outward movement of the drawer rail relative to the frame rail.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying drawings in which.

DETAILED DESCRIPTION OF THE DRAWINGS

Figure 1:
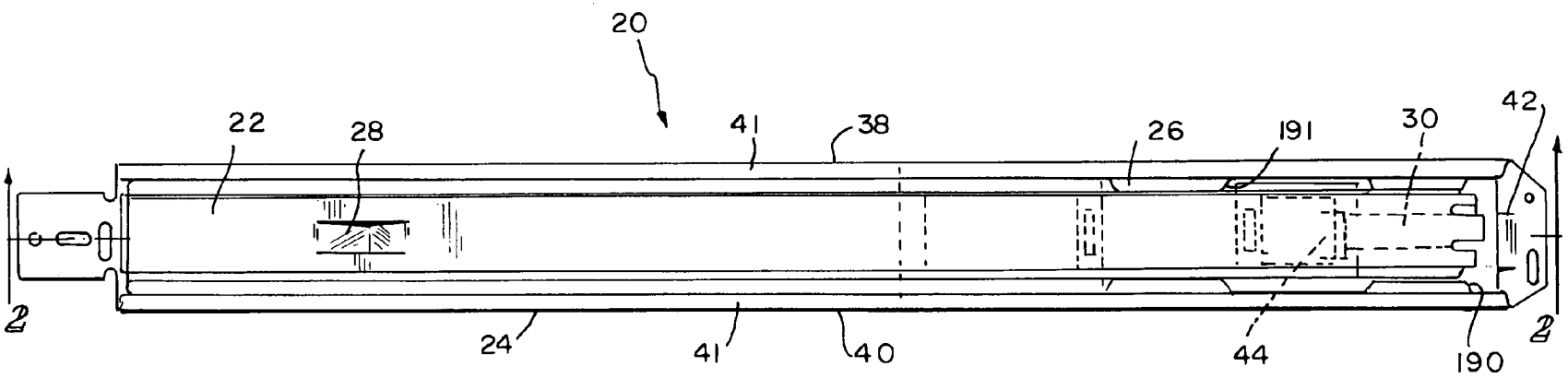
FIG. 1 is a plan view of a drawer slide assembly showing a frame rail, a drawer rail, and a bearing (parts of which are shown in phantom lines coupling the drawer rail to the frame rail for longitudinal movement of the drawer rail relative to the frame rail.

An illustrative embodiment of a drawer slide assembly 20 is shown in FIG. 1. Drawer slide assembly 20 includes an outer rail or frame rail 24 (shown more particularly in FIGS. 1, 2, 7, and 13–19), a carriage or bearing 26 (shown more particularly in FIGS. 1, 2, 5–12, and 14–20), and an inner rail or drawer rail 22 (shown more particularly in FIGS. 1–4, and 15–18), which cooperate to form assembly 20. As shown for example, in FIG. 15, drawer slide assembly 20 is used in cooperation with a drawer 80 and a frame 90.

Figure 15:
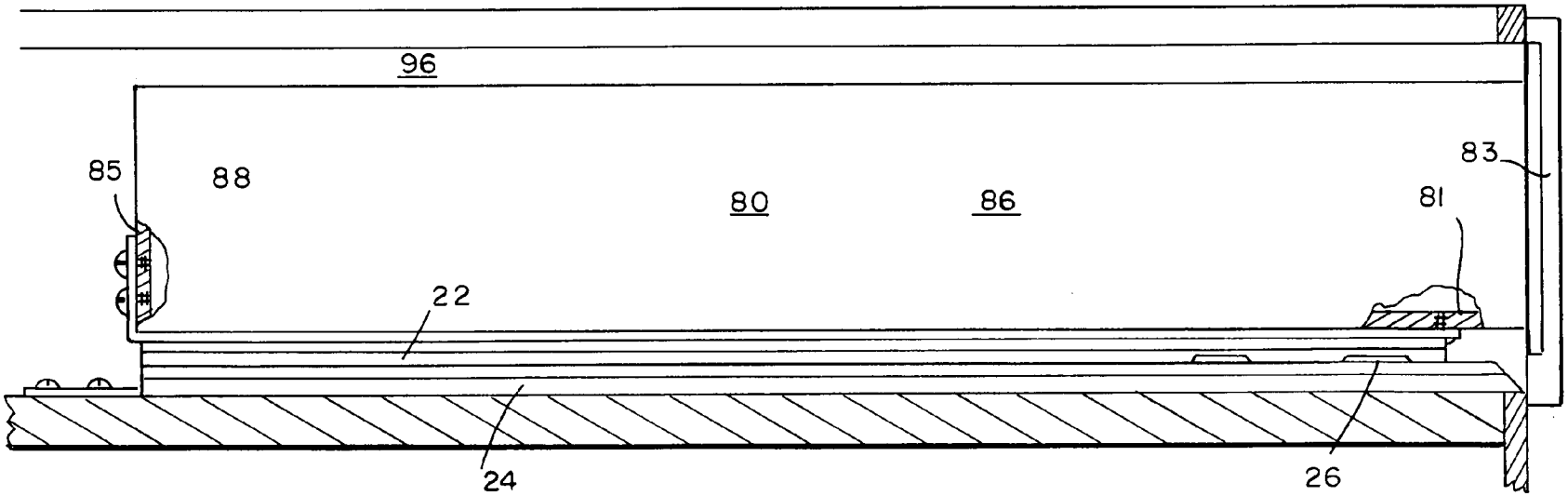
FIG. 15 is a side view with parts broken away of the drawer slide assembly of FIG. 1 attached to a drawer and a frame of a piece of furniture showing the drawer completely received within the frame of the furniture.
Figure 16:
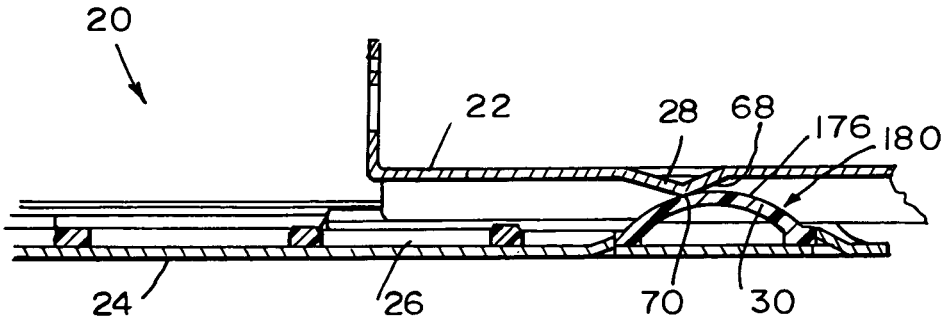
FIG. 16 is a sectional view of the drawer slide assembly of FIG. 1 showing the drawer rail moved outwardly with respect to the frame rail to the point that the rigid stop has engaged the flexible stop to inhibit further outward movement of the drawer rail relative to the frame rail.

Referring to FIG. 15, drawer slide assembly 20, drawer 80, and frame 90 are illustrated. In the illustrated embodiment, outer rail or frame rail 24 is configured for attachment to frame 90 and inner rail or drawer rail 22 is configured for attachment to drawer 80. Bearing 26 is received within frame rail 24 and provides a bearing surface for receipt of drawer rail 22. Bearing 26 and drawer rail 22 are configured to permit longitudinal reciprocal movement of drawer rail 22 relative to bearing 26 and frame rail 24. Bearing 26 is secured within frame rail 24 to prohibit longitudinal movement of bearing 26 with respect to frame rail 24 during longitudinal movement of drawer rail 22 with respect to bearing 26 and frame rail 24. Drawer rail 22 rides in bearing 26 to facilitate movement of drawer 80 relative to frame 90.

Illustratively, drawer rail 22 and bearing 26 are configured to limit outward longitudinal movement of drawer rail 22 relative to bearing 26 and frame rail 24 when a first level of force is applied to drawer rail 22. Thus, drawer 80, to which drawer frame 22 is attached, is inhibited from moving out of frame 90 beyond an initial stop point when a normal outward pull is exerted on the drawer 80. Drawer rail 22 and bearing 26 are configured to permit additional outward movement of drawer rail 22 relative to bearing 26 and frame rail 24 when a greater level of force is applied to drawer rail 22. Thus, by pulling harder on the drawer 80, drawer 80 can be moved farther outwardly, and even be removed, from frame 90. Those skilled in the art will recognize that it is within the scope of the present disclosure for outer rail or frame rail 24 to be attached to drawer 80 and inner rail or drawer rail 22 to be attached to frame 90.

Drawer 80 includes a bottom panel 81, side panels 86 and 88, face panel 83, and rear panel 85 cooperating to form an upwardly opening cavity. Frame 90 includes a drawer opening defined by upwardly facing surfaces 91, opposed inwardly facing side surfaces 96 (only one of which is shown in FIG. 15), and a downwardly facing surface 97. Drawer opening is sized to receive bottom panel 81, first side panel 86, second side panel 88, and rear panel 85 of drawer 80 therein.

Those skilled in the art will recognize that drawer slide assembly 20 is depicted having frame rail 24 attached to upwardly facing surface 91 of frame 90 and drawer rail 22 attached to underside of bottom panel 81 of drawer 80. By such arrangement, drawer slide assembly 20 is illustrated as being mounted as an under drawer slide. The terms upwardly, downwardly, inwardly and outwardly, and similar adverbial or adjectival terms will be used herein in describing drawer slide assembly 20 with the understanding that those terms accurately reflect the orientation of components of drawer slide assemblies mounted as under drawer slides. However, the usage of such directional terms is not intended to limit the scope of the invention to under drawer slides, since it is within the scope of the disclosure as presently perceived to mount drawer slide assembly 20 to drawer 80 and frame 90 in different fashions, e.g. mounting a single drawer slide assembly to a side panel 86 or 88 of drawer 80, mounting a drawer slide assembly to each side panel 86 and 88 of drawer 80, etc.

As shown, for example, in FIGS. 1, 2, 7, and 13–19, frame rail 24 has a first end 32, a second end 34, a bottom portion 36, a first side flange 38, and a second side flange 40. Bottom portion 36 is formed to include a front detent 42 and a rear detent 44. Referring to FIG. 15, first end 32 of frame rail 24 is attached to an outward, proximal portion 92 of frame 90 by screws or other appropriate fasteners or fastening arrangements. Second end 34 of frame rail 24 is attached to an inward, distal portion 94 of frame 90 by screws or other appropriate fasteners or fastening arrangements.

Illustratively, frame rail 24 is formed from a metallic material which is formed and stamped to create the features of frame rail 24. The illustrated frame rail 24 is configured to permit roll-forming of the component. First side flange 38 and second side flange 40 are spaced-apart with bottom portion 36 extending therebetween. Bottom portion 36 is substantially planar along its length and width to facilitate secure fastening of frame rail 24 to frame 90. Bottom portion 36 is formed to include attachment holes 37 extending therethrough within which fasteners (FIG. 15) are received for fastening frame rail 24 to frame 90.

Illustratively, bottom portion 36 of frame rail 24 is formed to include two upwardly extending detents 42 and 44 adjacent first end 32 of frame rail 24. Illustratively, detents 42 and 44 are stamped in bottom portion 36. Front detent 42 inclines rearwardly while rear detent 44 inclines forwardly.

Figures 5, 6, 7, 8, 9, 10, 11, 12, 20:
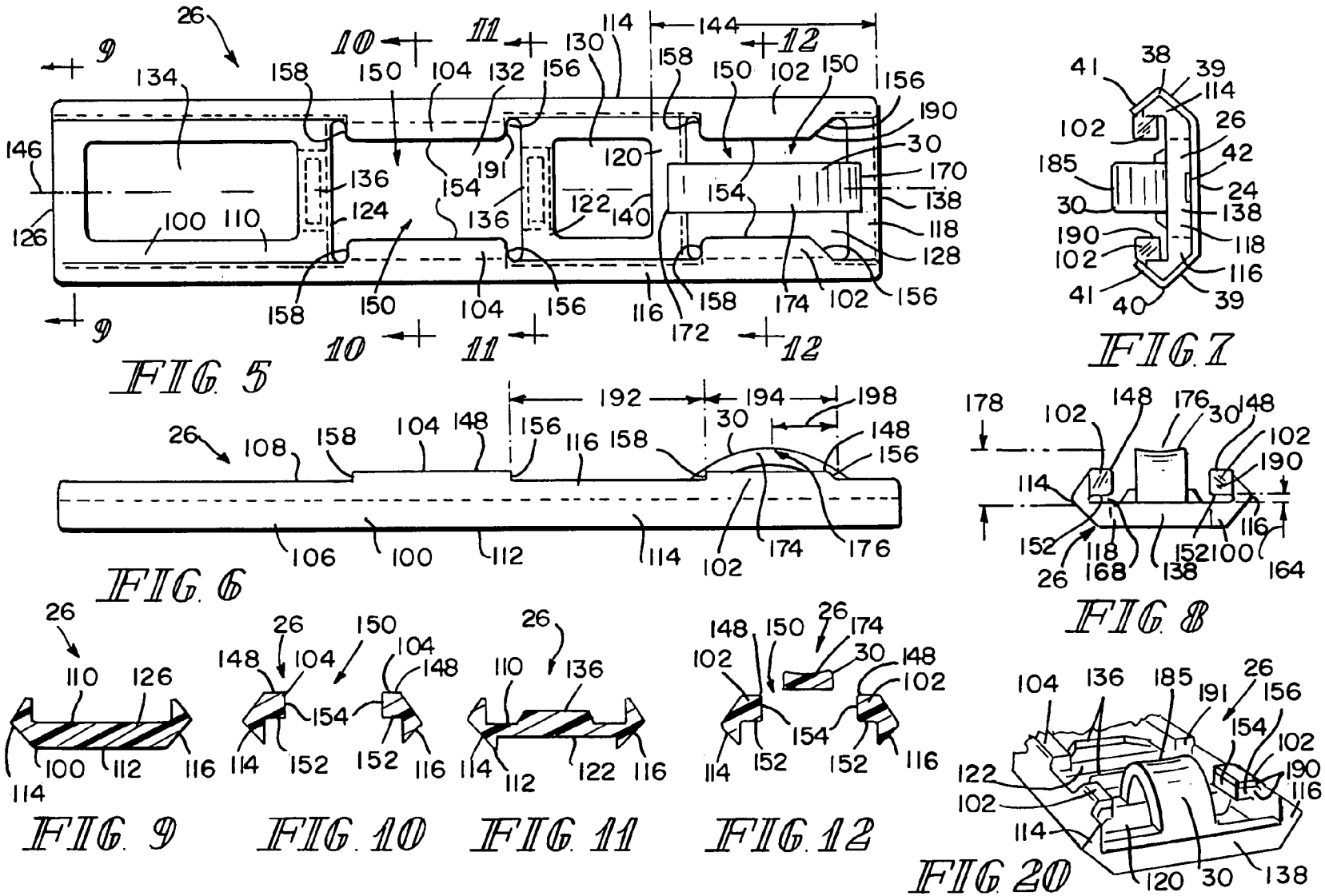
FIG. 5 is a plan view of the bearing of FIG. 1 showing spaced apart sidewalls joined together by a plurality of cross-members providing a bearing surface for the drawer rail to ride upon, a front and rear pair of clutches extending inwardly from the side wall to provide a bearing surface for the tops of the lips of drawer rail to ride against, a flexible stop extending between the first and second cross-members, and reinforcing structures formed on the third and fourth cross-members.
FIG. 6 is a side elevation view of the bearing of FIG. 5.
FIG. 7 is an end view of the bearing of FIG. 5 received within the frame rail of FIG. 1 showing how the inner surface of the frame rail and the outer surface of the bearing are conformably configured.
FIG. 8 is an end view of the bearing of FIG. 6.
FIG. 9 is a sectional view of the bearing taken along line 9—9 of FIG. 5.
FIG. 10 is a sectional view of the bearing taken along line 10—10 of FIG. 5.
FIG. 11 is a sectional view of the bearing taken along line 11—11 of FIG. 5.
FIG. 12 is a sectional view of the bearing taken along line 12—12 of FIG. 5.
FIG. 20 is a perspective view of a portion of the bearing.
Figure 13:
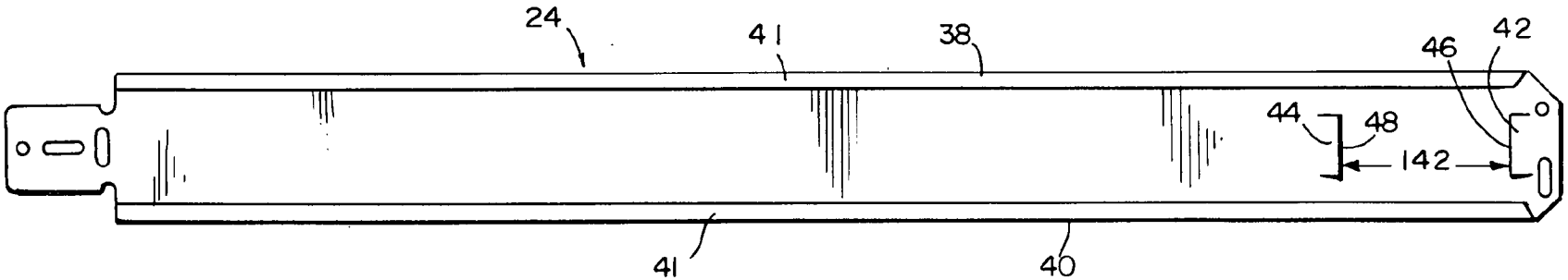
FIG. 13 is a plan view of the frame rail of FIG. 1 showing detents extending upwardly from the bottom surface to secure the bearing against longitudinal movement.
Figure 14:
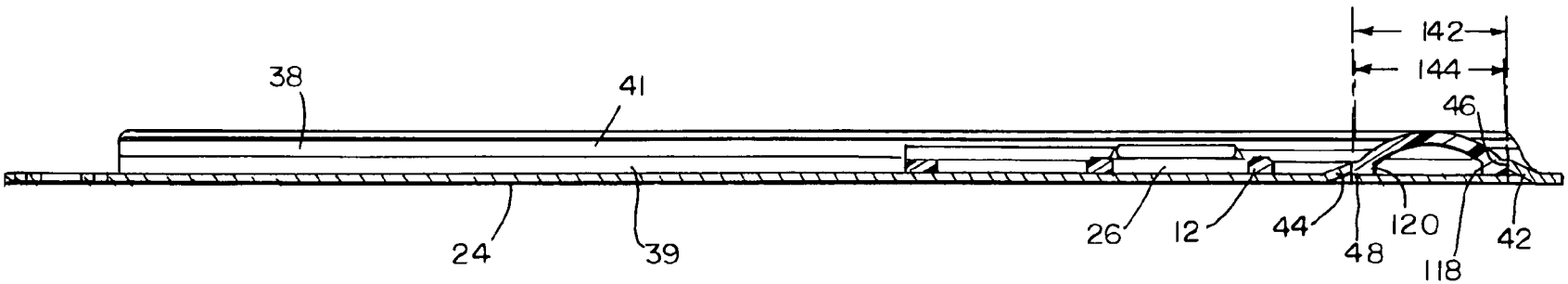
FIG. 14 is a sectional view of the frame rail and bearing of FIG. 2.

In the illustrated embodiment, the metallic material of frame rail 24 is bent to form first side flange 38 and second side flange 40. As shown in FIG. 7, first and second side flanges 38 and 40, respectively, include a first portion 39 extending laterally outwardly and upwardly (assuming frame rail 24 is mounted to an upwardly facing surface of frame 90) from side edges of bottom portion 36 and a second portion 41 extending inwardly and upwardly from first portion 39. Thus, first side flange 38 and second side flange 40 can be considered angled blades. As shown for example in FIG. 7, frame rail 24 has a substantially diamond C-shaped cross-section.

As shown for example in FIG. 7, bearing 26 and frame rail 24 are conformally shaped so that bearing can be retained within frame rail 24. When bearing 26 is received in frame rail 24 and properly positioned adjacent first end 32 of frame rail 24, reverse edge 46 of front detent 42 engages a portion of bearing 26 to prohibit longitudinal forward movement of bearing 26 with respect to frame rail 24. Similarly, when bearing 26 is received in frame rail 24 and properly positioned adjacent first end 32 of frame rail 24, front edge 48 of rear detent 44 engages a portion of bearing 26 to prohibit longitudinal rearward movement of bearing 26 with respect to frame rail 24. Side flanges 38 and 40 prohibit upward and downward movement of bearing 26 with respect to frame rail 24. Thus, bearing 26 is securely held within frame rail 24 in a fixed position.

Drawer rail 22 has a first end 50, a second end 52, a top portion 54, an upwardly extending attachment flange 53, a first side wall 56, a second side wall 58, and outwardly extending lips 60 and 62. First side wall 56 and second side wall 58 are spaced-apart with top portion 54 extending therebetween. Illustratively, top portion 54 is substantially planar to facilitate attachment of drawer rail 22 to the underside of bottom panel 81 of drawer 80. First end 50 of drawer rail 22 is attached to an outward, proximal portion 82 of drawer 80 and second end 52 of drawer rail 22 is attached to an inward, distal portion 84 of drawer 80. In the illustrated embodiment, attachment flange 53 extends upwardly from top portion 54 and is attached by screws or other fasteners or fastening methods to rear panel 85 of drawer 80.

Figure 4:
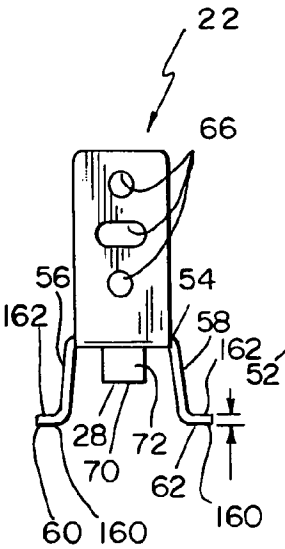
FIG. 4 is a end view of the drawer rail of FIG. 1 showing an upwardly extending attachment flange facilitating attachment of the drawer rail to the back of a drawer, sidewalls extending downwardly and outwardly from the top wall of the drawer rail, lips extending outwardly from the bottom of each sidewall, and the rigid stop extending downwardly from the top wall.

A lip 60, 62 extends outwardly from the bottom end of each of first and second walls 56 and 58, respectively. Drawer rail 22 is substantially symmetrical about a vertical plane intersecting its longitudinal axis 64. Top portion 54 and attachment flange 53 are formed to include attachment holes 66 through which fasteners (not shown) extend to attach drawer rail 22 to drawer 80. As shown in FIG. 4, drawer rail 22 has a substantially box U-shaped or box Ω-shaped cross section. Like frame rail 24, drawer rail 22 is illustratively formed of a metallic material to facilitate forming of the part through standard stamping, cutting and bending operations. The illustrated drawer rail 22 is configured to permit roll-forming of the component. Those skilled in the art will recognize that drawer rail 22 and frame rail 24 can be made from non-metallic materials within the scope of the invention.

Top portion 54 is formed to include a downwardly projecting rigid stop 28. Illustratively, rigid stop 28 is formed by cutting two spaced apart parallel slots on opposite sides of longitudinal axis 64 of drawer rail 22 and stamping the longitudinally extending strip of material between the slots so that rigid stop 28 extends downwardly adjacent longitudinal axis 64. Rigid stop 28 has a inclined front wall 68, a bend 70 and a inclined front wall 72. Bend 70 is the lowermost extending point of rigid stop 28 and is spaced vertically downwardly apart from top portion 54 by a displacement 74. Inclined front wall 68 extends downwardly and rearwardly from top portion 54 to bend 70. An angle 76 is formed between top portion 54 and inclined front wall 68. Similarly an angle 78 is formed between top portion 54 and inclined front wall 72. In the illustrated embodiment of drawer slide assembly 20, angle 76 is less than angle 78 so that it is easier deflect flexible stop 30 during insertion of drawer rail 22 into bearing 26 than it is to deflect flexible stop 30 during removal of drawer rail 22 from bearing 26.

Bearing 26 includes flexible stop 30, a front cross-member 118, to contact the front detent 42 and a forward middle cross-member 120 to contact rear detent 44 whereby the longitudinal travel of bearing 26 relative to frame rail 24 is prohibited. Drawer rail 22 is disposed within bearing 26 and is longitudinally moveable therein. Flexible stop 30 limits the outward travel of drawer rail 22 by contacting rigid stop 28. Thus, when used in cooperation with drawer 80 and frame 90 as shown in FIG. 15, drawer 80 may slide freely within frame 90 but flexible stop 30 in cooperation with rigid stop 28 stops drawer 80 from inadvertently traveling beyond the confines of frame 90. Although the illustrated embodiment shows assembly 20 in an undermount position relative to drawer 80, it is to be understood by those skilled in the art that the present invention is envisioned to be equally applicable to mounting on sides 86, 88 of drawer 80 and sides 96 and 98 of frame.

Referring now to FIGS. 1, 2, 5–12, and 14–19, bearing 26 is illustrated. The illustrated embodiment of bearing 26 is formed to include a base 100, a front pair of clutches 102, a rear pair of clutches 104 and flexible stop 30. Base 100 includes a bottom portion 106, and a top portion 108. Illustratively, bottom portion 106 of base 100 has a top surface 110 and a bottom surface 112 and is formed from longitudinally extending first and second sides 114 and 116, respectively, and cross-members 118, 120, 122, 124 and 126. Front cross-member 118, forward middle cross-member 120, first side 114, and second side 116 define a front rectangular opening 128. Forward middle cross-member 120, center middle cross-member 122, first side 114, and second side 116 define a front central opening 130. Center middle cross-member 122, rearward middle cross-member 124, first side 114, and second side 116 define a rear central opening 132. Rearward middle cross-member 124, rear cross-member 126, first side 114, and second side 116 define a rear rectangular opening 134.

Flexible stop 30 extends between front cross-member 118 and forward middle cross-member 120 spanning front rectangular opening 128 which provides free space within which flexible stop 30 may be flexed. Thus, the rectangular shape of the opening 128 should not act as a limitation on the scope of the disclosure. Front central opening 130, rear central opening 132 and rear rectangular opening 134, and certain areas of front rectangular opening 128, serve to reduce the material requirements of bearing 26. However, because the lateral rigidity of bearing 26 is compromised by the elimination of the material in front central opening 130, rear central opening 132 and rear rectangular opening 134, and certain areas of front rectangular opening 128, stiffening elements 136 are added to the upper surface of center middle cross-member 122 and rearward middle cross-member 124. Stiffening elements 136 reduce the tendency of bearing 26 to twist and become dislodged from frame rail 24.

Figure 2:
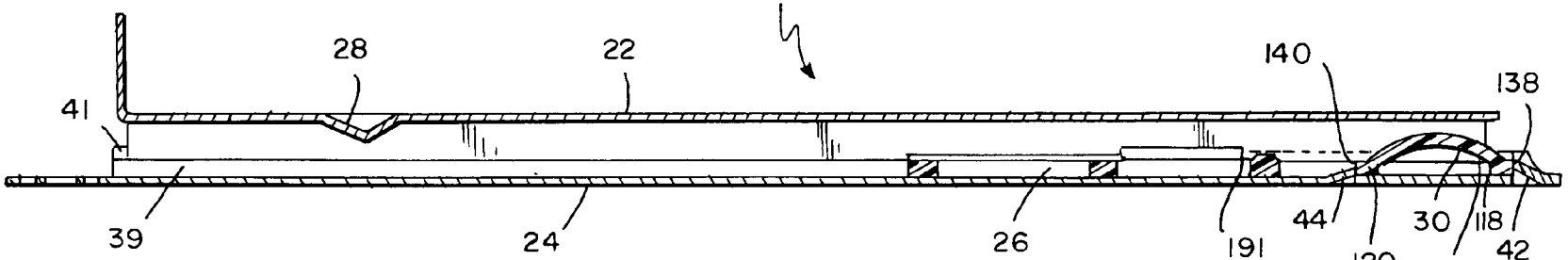
FIG. 2 is a sectional view of the drawer slide assembly along the line 2— 2 of FIG. 1 showing a rigid stop extending downwardly from the drawer rail, a flexible stop extending upwardly from the bearing and a pair of detents securing the bearing to the frame rail.
Figure 3:
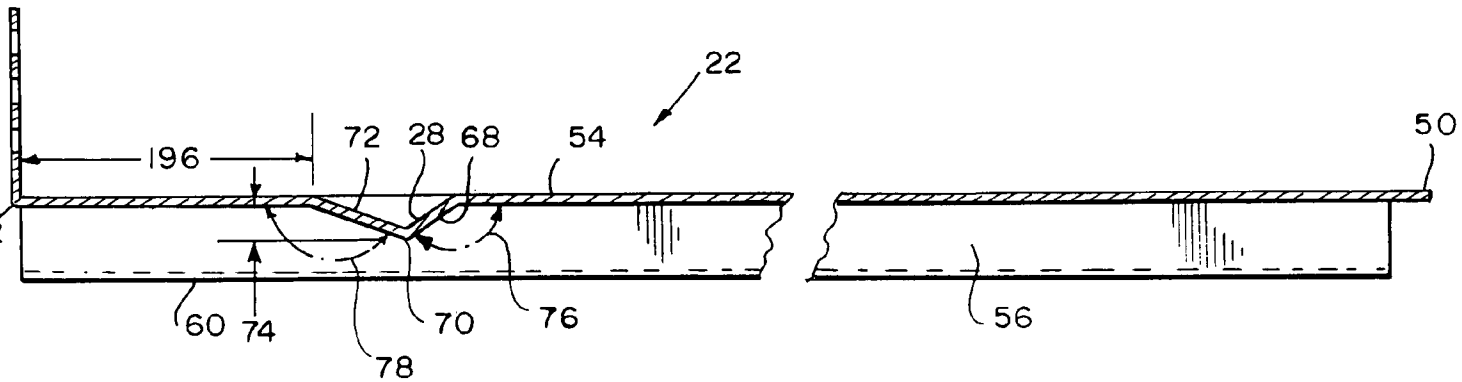
FIG. 3 is a sectional view of the drawer rail of FIG. 1 showing the rigid stop extending downwardly from a top surface of the drawer rail.

Front cross-member 118 of base 100 includes a forwardly facing wall 138 extending between top surface 110 and bottom surface 112 of bottom portion 106. As shown in FIG. 2, forwardly facing wall 138 is preferably formed to have a sharp lower edge to engage front detent 42 to limit the outward travel of bearing 26 within frame rail 24. Similarly, front middle cross-member 120 of base 100 includes a rearwardly facing wall 140 extending between top surface 110 and bottom surface 112 of bottom portion 106. As shown in FIG. 2, rearwardly facing wall 140 is preferably formed to have a sharp lower edge to engage rear detent 44 to limit the inward travel of bearing 26 within frame rail 24. Forwardly facing wall 138 and rearwardly facing wall 140 are spaced apart by a displacement 144 substantially equal to, or slightly less than, the displacement 142 between rear edge 46 of front detent 42 and front edge 48 of rear detent 44. Thus, when held in frame rail 24, bearing 26 is prevented from moving inwardly or outwardly with respect to frame rail 24. Those skilled in the art will recognize that it is within the scope of the disclosure for displacement 142 between front edge 48 of rear detent 44 and rear edge 46 of front detent 42 to be greater than displacement 144 between front facing wall and rear facing wall to permit bearing 26 to slide inwardly and outwardly, within limits, with respect to frame rail 24.

Top portion 108 extends upwardly from top surface 110 of first and second sides 114 and 116, respectively. Top portion 108 includes front pair of clutches 102 and rear par of clutches 104 extending laterally inwardly toward longitudinal axis 146. Each pair of clutches 102, 104 includes an upper wall 148, a bottom wall 152, an inwardly facing wall 154, a forwardly facing wall 156 and a rearwardly facing wall 158. Each clutch of pairs of clutches 102, 104 is positioned to be in spaced-apart and confronting relationship to its associated clutch of pairs of clutches 102, 104 on opposite sides of the bearing 26. Inwardly facing walls 154 of associated pairs of clutches 102, 104 are spaced apart from each other to define a gap 150 therebetween within which side walls 56 and 58 and top portion 54 of drawer rail 22 are slidably received for longitudinal movement relative to bearing 26.

Outwardly extending lips 60, 62 of drawer rail 22 are slidably disposed within bearing 26. Top surface 110 of bottom portion 106 acts to limit downward movement of drawer rail 22 with respect to bearing 26 and acts as a surface against which the bottom surface 160 of outwardly extending lips 60, 62 may ride during longitudinal movement of drawer rail 22 with respect to bearing 26. Bottom walls 152 of clutches 102, 104 provide a surface against which upper surface 162 of outwardly extending lips 60, 62 of drawer rail 22 may ride during longitudinal movement of drawer rail 22 with respect to bearing 26. In the illustrated embodiment, front pair of clutches 102 extend into front rectangular opening 128. In the illustrated embodiment, rear pair of clutches 104 extend into rear central opening 132. Thus, in the illustrated embodiment, the bottom walls 152 of front and rear pairs of clutches 102, 104 are not positioned immediately vertically above top surface 110 of bottom portion 106 of base 102 of bearing 26. Nevertheless, bottom walls 152 of clutches 102, 104 are vertically displaced from top surface 110 of bottom portion 106 of base 100 by a displacement 164. Those skilled in the art will recognize that displacement 164 is approximately equal to, or slightly greater than, the thickness 166 of the material from which outwardly extending lips 60, 62 of drawer rail 22 are formed. Thus, bottom walls 152 of clutches 102, 104 and top surface 110 of sides 114, 116 of bottom portion 106 of base 100 form a track 168 for receipt of outwardly extending lips 60, 62 of drawer rail 22.

Bearing 26 is configured to be disposed in a fixed position within frame rail 24 in the illustrated embodiment. Illustratively, bearing 26 is embraced by angled blades of side flanges 38 and 40 to prohibit lateral movement of bearing 26 with respect to frame rail 24. As shown, for example, in FIG. 7, bearing 26 has a diamond C-shaped cross section facilitating receipt of bearing 26 within frame rail 24.

In the illustrated embodiment, when bearing 26 is disposed within frame rail 24, bearing 26 is fixed longitudinally within frame rail 24 between limits. Forwardly facing wall 138 of front cross-member 118 engages rear edge 46 of front detent 42 to limit the outward movement of bearing 26 relative to frame rail 24. Rearwardly facing wall 140 of front middle cross-member 120 engages front edge 48 of rear detent 42 to limit the inward movement of bearing 26 relative to frame rail 24. The engagement between forwardly facing wall 138 of front cross-member 118 and rear edge 46 of front detent 42 also acts to prevent deformation of front cross-member 118 when flexible stop 30 is being flexed. The engagement between rearwardly facing wall 140 of front middle cross-member 120 and front edge 48 of rear detent 44 also acts to prevent deformation of front middle cross-member 120 when flexible stop 30 is being flexed. Those skilled in the art will recognize that longitudinal movement of bearing 26 with respect to frame rail 24 may be limited by other properly configured structural elements of bearing 26 and frame rail 24.

As previously stated, bearing 26 is further formed to include flexible stop 30 which cooperates with rigid stop 28 of drawer rail 22 to selectively limit outward movement of drawer rail 22 with respect to bearing 26. Illustratively, flexible stop 30 includes a fixed front end 170, a fixed rear end 172, and an arch-shaped body 174. Fixed front end 170 is attached to top surface 110 of front cross-member 118 to be symmetric about a vertical plane running through longitudinal axis 146. Fixed rear end 172 is attached to top surface 110 of front middle cross-member 120 to be symmetric about a vertical plane running through longitudinal axis 146. Arch-shaped body 174 extends longitudinally between fixed front end 170 and fixed rear end 172. Illustratively, arch-shaped body 174 is formed from a strip of material extending between fixed front end 170 and fixed rear end 172. The upper most portion 176 of arch-shaped body 174 is displaced from top surfaces 110 of front and front middle cross-members 118, 120, respectively, by a distance 178 sufficient to allow uppermost portion 176 to engage bend 70 of rigid stop 28. Arch-shaped body 174 is configured to allow flexible stop 30 to assume a first, natural position wherein flexible stop 30 inhibits outward movement of drawer rail by engaging rigid stop 28 and a second, deformed position wherein rigid stop 28 does not engage flexible stop 30. Arch-shaped body 174 is designed to return to the first, natural position after deformation to the second, deformed position. Those skilled in the art will recognize that flexible stop 30 can be formed to have shapes other than arch-shaped which permit flexible stop 30 to assume a first natural position wherein flexible stop inhibits outward movement of drawer rail by engaging rigid stop 28 and a second, deformed position wherein rigid stop 28 does not engage flexible stop 30 and flexible stop 30 returns to the first, natural position after deformation to the second, deformed position.

Flexible stop 30 is disposed above front rectangular opening 128 to permit flexible stop 30 to be flexed vertically. In the illustrated embodiment, when flexible stop 30 is in the first natural position 180, and drawer rail 22 is slidably received in bearing 26, arch-shaped body 174 has a convex upwardly facing surface 182 and a concave downwardly facing surface 184. In the illustrated embodiment convex upwardly facing surface 182 exhibits a concavity 185 across the lateral axis. Arch-shaped body 174 is symmetrical about a vertical plane passing through longitudinal axis 146. Flexible stop 30 and rigid stop 28 are each symmetrical about the vertical plane passing through longitudinal axes 64 and 146.

FIGS. 16–19 illustrate a drawer rail 22 being removed from bearing 26 received in frame rail 24. The drawer 80 to which drawer rail 22 is attached and frame 90 to which frame rail 24 is attached are removed for clarity in FIGS. 16–19. As drawer rail 22 is moved outwardly with respect to bearing 26, bend 70 and lower portions of inclined front wall 68 of rigid stop 28 engages uppermost portion 176 of flexible stop 30 when flexible stop 30 is in the first natural position 180 to limit outward motion of drawer rail 22 with respect to bearing 26, as shown for example in FIG. 16. The frictional engagement between flexible stop 30 and rigid stop 28 is sufficient to inhibit further outward movement of drawer rail 22 with respect to bearing 26 when a moderate pulling force is applied to drawer 80 to which drawer rail 22 is attached. When a greater pulling force is applied to drawer 80 to which drawer rail 22 is attached, flexible stop 30 is deformed to a second deformed position 188, as shown, for example, in FIG. 17. In second deformed position 188, flexible stop 30 is deformed sufficiently to permit bend 70 of rigid stop 28 to pass over uppermost portion 176 of flexible stop 30. Once bend 70 of rigid stop 28 has passed outwardly beyond uppermost portion 176 of flexible stop 30, as shown, for example, in FIG. 18, drawer 80 to which drawer rail 22 is attached can be completely removed from frame 90 by continuing to pull outwardly on drawer 80, as shown, for example, in FIG. 19. Also, once bend 70 of rigid stop 28 has passed outwardly beyond uppermost portion 176 of flexible stop 30, flexible stop 30 returns to first natural position 180.

Figure 17:
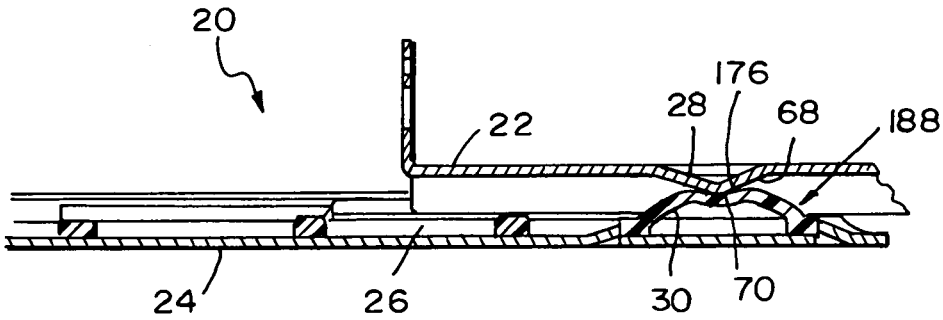
FIG. 17 is a sectional view similar to FIG. 16 showing the flexible stop deformed to permit further outward movement of the drawer rail relative to the frame rail.
Figure 18:
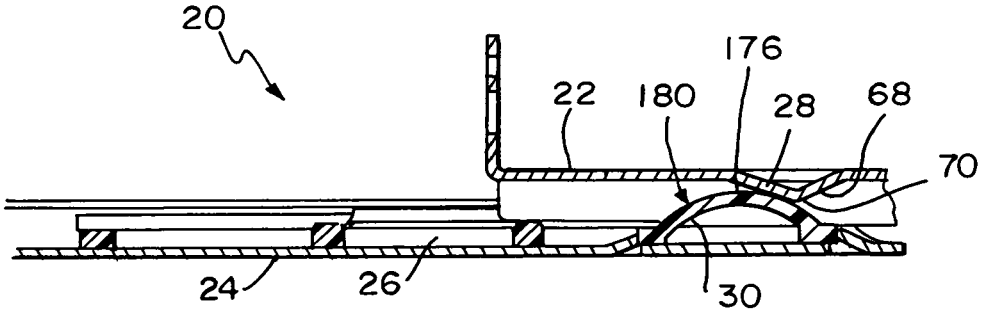
FIG. 18 is a sectional view similar to FIG. 17 showing the drawer rail moved sufficiently outward relative to the frame rail so that the flexible stop has returned to its original shape and no longer inhibits outward movement of the drawer rail relative to the frame rail.
Figure 19:
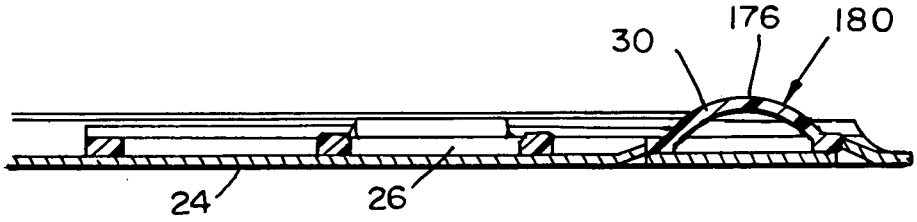
FIG. 19 is a sectional view of the drawer slide assembly similar to FIG. 18 after the drawer rail has been completely removed from the frame rail.

As shown in FIG. 17, during deformation of flexible stop 30 between the first natural position 180 and the second deformed position 188, uppermost portion 176 of arch-shaped body 174 is flexed downwardly. Additionally, slight deformation may occur in the laterally concave surface 185 of upper convex surface 182 to facilitate passage of rigid stop 28 over flexible stop 30. The entire bearing 26 may be somewhat deformed during passage of rigid stop 28 over flexible stop 30. It may be that pressure exerted by upper surface 162 of outwardly extending lips 60, 62 on the bottom wall 152 of the pairs clutches 102, 104 causes clutches 102, 104 to deform slightly to permit passage of rigid stop 28 over flexible stop 30. Those skilled in the art will recognize that it is within the scope of the disclosure for flexible bearing 30 to have some other shape than that shown in the illustrated embodiment. Similarly, rigid stop 28 could be configured differently than in the illustrated embodiment within the scope of the present disclosure.

In the illustrated embodiment, each of front pair of clutches 102 includes a chamfered edges 190. (Best seen in FIG. 20.) In the illustrated embodiment chamfered edges 190 are formed from a compound angle on the front wall 156 of forward clutches 102. The compound angle chamfered edge 190 aids in funneling lips 60, 62 into track 168 during insertion of drawer rail 22 into bearing 26. In the illustrated embodiment, front wall 156 of rear clutches 104 includes a less funneled chamfered edge 191 than front set of clutches 102. The chamfered edge 191 in rear set of clutches 104 can be less funneled because upward and sideways movement of lips 60, 62 is substantially restricted by bottom surface 152 of front pair of clutches 102 and top surface 110 of bottom portion 106 of bearing 26 by the time that the rear edge 52 of drawer rail 22 reaches rear clutches 104 during insertion. Those skilled in the art will recognize that rear clutches 104 could be formed with a compound angle chamfered edge 190 similar to front pair of clutches 102 within the scope of the disclosure.

In the illustrated embodiment, bearing 26 is formed from high density polyethylene (HDPE). HDPE is especially suited to this application since it is a relatively inexpensive material, easily formed, durable and self-lubricating in the instant application. However, those skilled in the art will recognize that bearing 26 may be manufactured from other materials within the scope of the invention.

In use, frame rail 24 is attached to frame 90 by nails, screws, staples, or other suitable fasteners (FIG. 15). In use, drawer rail 22 is attached to drawer 80 by nails, screws, staples, or other suitable means (FIG. 15). Drawer rail 22 is positioned on drawer 80 such that rigid stop 28 faces downward when drawer 80 is in its normal position.

Referring to FIGS. 16–19, bearing 26 is received in frame rail 24 and drawer rail 22 is slidably received within gap 150 with outwardly extending lips 60, 62 held in track 168 formed between bottom surfaces 152 of pairs of clutches 102, 104 and top surface 110 of bottom portion 106 of bearing 26. In the preferred embodiment, front surface 138 of front cross-member 118 of bearing 26 engages rear edge 46 of first detent 42 of frame rail 24 and rear surface 140 of forward middle cross-member 120 of bearing 26 engages front edge 48 of rear detent 44 of frame rail 24. Bearing 26 is securely held in a fixed position relative to frame rail 24. Outward movement of bearing 26 with respect to frame rail 24 is limited by the engagement of front surface 138 of front cross-member 118 of bearing 26 with rear edge 46 of first detent 42 of frame rail 24. Inward movement of bearing 26 with respect to frame rail 24 is limited by the engagement of rear surface 140 of forward middle cross-member 120 of bearing 26 with front edge 48 of rear detent 44 of frame rail 24.

To mount the drawer 80 within the frame 90, drawer rail 22 is slidably disposed within gap 150 defined between respective pairs of clutches 102, 104 of bearing 26. As drawer 80 with attached drawer rail 22 is slid into gap 150, outwardly extending lips 60, 62 of drawer rail 22 are slid into the front portion of track 168 formed between top surface 110 of bottom portion 106 of bearing 26 and bottom walls 152 of front pair of clutches 102. Front pair of clutches 102 and top surface 110 of bottom portion 106 of bearing 26 align outwardly extending lips 60, 62 vertically for receipt in back portion of track 168 formed by bottom walls 152 of rear clutches 104 and top surface 110 of bottom portion 106 as drawer rail 22 is slid inwardly. After rear portions of outwardly extending lips 60, 62 are received in track 168 further inward movement of drawer rail 22 causes inclined front wall 72 of rigid stop 28 to engage flexible stop 30. Further inward movement of drawer rail 22, with an increased force, causes rigid stop 28 to urge flexible stop 30 from its first, natural position 180 to its second, flexed position 188. When flexible stop 30 is in its flexed position 188, rigid stop 28 passes over flexible stop 30. After passage of rigid stop 28 over flexible stop 30, flexible stop 30 returns to its first natural position 180. Those skilled in the art will recognize that the differences between angle 76 and 78 allows less force to be exerted on drawer rail 22 to deflect flexible stop 30 during insertion of drawer rail 22 into bearing 26 than is required to deflect flexible stop 30 during removal drawer rail 22 from bearing 26.

In operation, assembly 20 provides a smooth mechanism for aligning drawer 80 in frame 90 and maintaining the position of drawer 80 within frame 90. When installed, drawer 80 is constrained from traveling outwardly by contact between flexible stop 30 and rigid stop 28. Conveniently, when it is desirous to remove the drawer 80 from frame 90, the exertion of additional outward force on the drawer 80 induces deformation of flexible stop 30 from first, natural position 180 wherein it extends upwardly in longitudinal alignment with rigid stop 28 to the second, flexed position 188 wherein, while it is in longitudinal alignment with rigid stop 28, it does not prohibit rigid stop 28 from passing thereover thereby enabling drawer 80 to be removed from frame 90.

During insertion or removal of drawer rail 22 from bearing 26, fixed stop 28 engages flexible stop 30. Inclined front wall 68 and inclined front wall 72 of fixed stop 30 and arch shaped body 174 of flexible stop 30, when in contact, cooperate to urge drawer rail 22 upwardly with respect to bearing 26. Thus, upper surfaces 162 of outwardly extending lips 60, 62 are urged against bottom surfaces 152 of pairs of clutches 102, 104 when fixed stop 28 is in engagement with flexible stop 30. The force exerted on bottom surfaces 152 of clutches 102, 104 creates a torque about an axis extending through each side wall 114, 116 of bearing 26. This torque is counteracted by the material forming side walls 114, 116 of bearing 26 as well as cross-members 118, 120, 122, 124, 126 extending between side walls 114, 116. The torque tends to cause cross-members 118, 120, 122, 124, 126 to flex allowing side walls 114, 116 to rotate about the axes extending longitudinally therethrough. As mentioned previously, in the illustrated design, cross-members 122, 124 are provided with stiffeners 136. These stiffeners 136 strengthen cross-members 122, 124 to inhibit deformation of cross-members 122, 124 by the torque created when the flexible stop 30 is in engagement with the fixed stop 28. To some extent, front end 170 of flexible stop 30 stiffens front cross-member 118 to inhibit deformation of front cross-member 118 by the torque created when the flexible stop 30 is in engagement with the fixed stop 28. Likewise, to some extent, rear end 172 of flexible stop 30 stiffens forward middle cross-member 120 to inhibit deformation of forward middle cross-member 120 by the torque created when the flexible stop 30 is in engagement with the fixed stop 28.

In the illustrated embodiment, front pair of clutches 102 and rear pair of clutches 104 are displaced from each other by a displacement 192. Each clutch of front pairs of clutches 102 has a length 194. The rear edge of inclined rear wall 72 of fixed stop 28 is displaced from the distal end 52 of drawer rail 22 by a displacement 196. Front pair of clutches 102 is concurrent with flexible stop 30. This helps to prevent drawer rail 22 from riding out of bearing 26 during deformation of flexible stop 30. The upper most point 176 of flexible stop 28 is located longitudinally rearwardly from the front walls 156 of front pair of clutches 102. Thus, the longitudinal displacement 198 between upper most point 176 of flexible stop 30 and front walls 156 of rear pair of clutches 104 is less than the sum of the length 194 of front clutches 102 and the displacement 192 between front clutches 102 and rear clutches 104. In the illustrated embodiment, displacement 196 between distal end 52 of drawer rail 22 and rear end of inclined rear wall 72 of fixed stop 28 is slightly greater than the sum of displacement 192 between rear pair of clutches 104 and front pair of clutches 102 and the length 194 of front pair of clutches 102 so that the distal end 52 of outwardly extending lips 60, 62 is located below bottom surfaces 152 of rear pair of clutches 104 before fixed stop 28 engages flexible stop 30 during insertion of drawer rail 22 into bearing 26.

Additionally, because of the arrangement and positioning of clutches 102, 104 and flexible stop 30 in bearing 26 and the arrangement and positioning of fixed stop 28 relative to distal end 52 of drawer rail 22, as drawer 80 is pulled out from frame 90, portions of outwardly extending lips 60, 62 remain below bottom surfaces 152 of both front and rear pairs of clutches 102, 104 until fixed stop 28 passes over flexible stop 30. The load exerted by the drawer rail 22 on bearing 26 is greatest when the drawer 80 is cantilevered. Thus, when the drawer 80 is extended to the stop position it is highly cantilevered and exerts a high load on bearing 26. The illustrated arrangement of components counteracts this load by having the outwardly extending lips 60, 62 below both the front and rear pair of clutches 102, 104 when drawer 80 is in the stop position.

Figure 21:
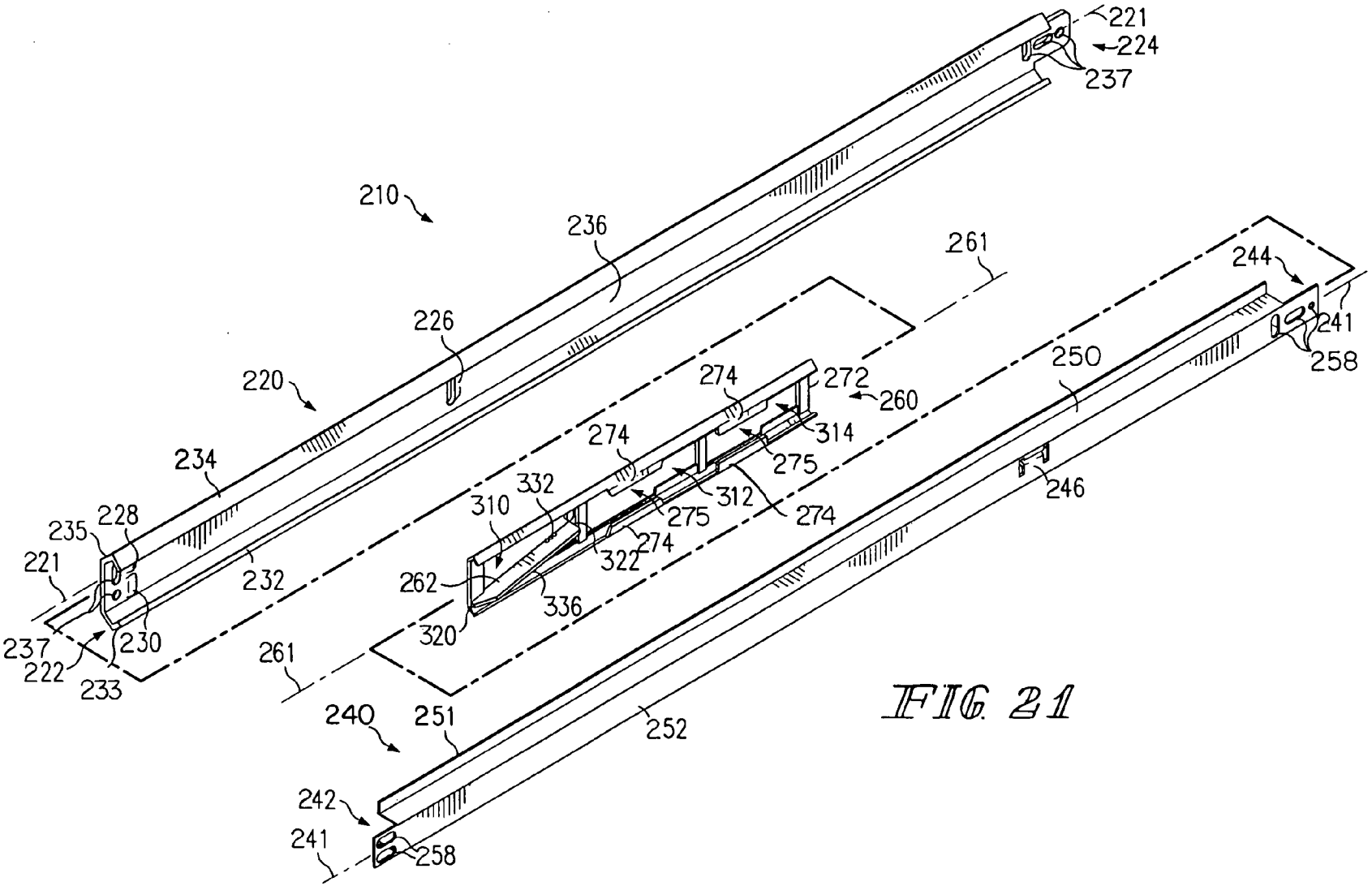
FIG. 21 is an exploded view of the slide assembly showing a relative position of a channel, a carriage, and a rail.

An alternative embodiment of a drawer slide assembly 210 in accordance with the present invention is shown in FIG. 21. Drawer slide assembly 210 includes a channel 220, a carriage 260, and a rail 240, which cooperate to form assembly 210. Further reference is made to FIG. 32 which shows assembly 210 in cooperation with a drawer 80 and a frame 90.

Figure 32:
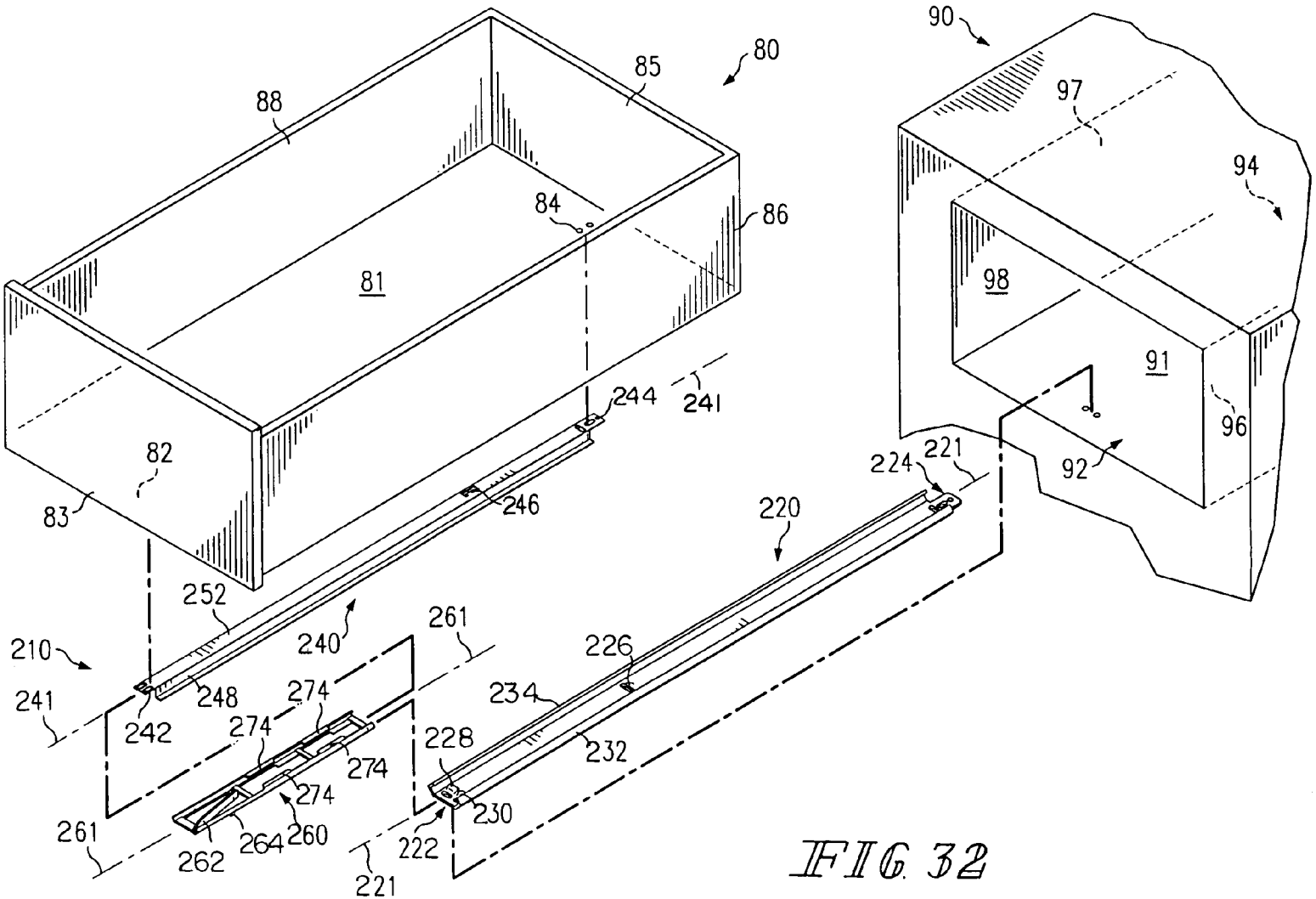
FIG. 32 is an exploded view of the slide assembly in combination with a drawer and a frame.

Referring to FIG. 32, drawer slide assembly 210, drawer 80, and frame 90 are illustrated in an exploded view. Rail 240 of drawer slide assembly 210 slides within carriage 260. Drawer 80 includes a bottom panel 81, first and second side panels 86, 88, respectively, face panel 83, and rear panel 85 cooperating to form an upwardly opening cavity. Frame 90 includes a drawer opening defined by upwardly facing surfaces 91, opposed inwardly facing side surfaces 96, 98, and a downwardly facing surface 97. Drawer opening is sized to receive bottom panel 81, first side panel 86, second side panel 88, and rear panel 85 of drawer 80 therein. As shown, in FIG. 32, channel 220 is configured for attachment to frame 90 and rail 240 is configured for attachment to drawer 80. Carriage 260 rides within channel 220 and rail 240 rides in carriage 260 to facilitate movement of drawer 80 relative to frame 90.

Carriage 260 includes flexible finger 262, a stop 264 to contact at least one of the detents 226, 228, 230 whereby the travel of carriage 260 is limited relatively to channel 220. Rail 240 is disposed within carriage 260 and is longitudinally moveable therein. Flexible finger 262 limits the outward travel of rail 240 by contacting tab 246. Thus, when used in cooperation with drawer 80 and frame 90 as shown in FIGS. 21 and 32, drawer 80 may slide freely within frame 90 but flexible finger 262 in cooperation with tab 246 stops drawer 80 from inadvertently traveling beyond the confines of frame 90. Although the illustrated embodiment shows assembly 210 in an undermount position relative to drawer 80, it is to be understood by those skilled in the art that the present invention is envisioned to be equally applicable to mounting on sides 86, 88 of drawer 80 and sides 96 and 98 of frame.

Those skilled in the art will recognize that drawer slide assembly 210 is depicted having channel or first track 220 attached to upwardly facing surface 91 of frame 90 and rail or second channel 240 attached to underside of bottom panel 81 of drawer 80. By such arrangement, drawer slide assembly 210 is illustrated as being mounted as an under drawer slide. The terms upwardly, downwardly, inwardly and outwardly, and similar adverbial or adjectival terms will be used herein in describing drawer slide assembly 210 with the understanding that those terms accurately reflect the orientation of components of drawer slide assemblies mounted as under drawer slides. However, the usage of such directional terms is not intended to limit the scope of the invention to under drawer slides, since it is within the scope of the disclosure as presently perceived to mount drawer slide assembly 210 to drawer 80 and frame 90 in different fashions, eg mounting a single drawer slide assembly to a side panel 86 or 88 of drawer 80, mounting a drawer slide assembly to each side panel 86 and 88 of drawer 80, etc.

Channel or outer track 220 has a first end 222, a second end 224, a bottom portion 236, a first side flange 232, and a second side flange 234. Bottom portion 236 is formed to include at least one detent 230. In the illustrated embodiment, two additional detents 226 and 228 are shown but it is to be understood that multiple detents are not necessary.

Referring to FIG. 32, the exploded view indicates that in use, first end 222 of channel 220 is attached to an outward, proximal portion 92 of frame 90 and second end 224 of channel 220 is attached to an inward, distal portion 94 of frame 90.

Figure 31:
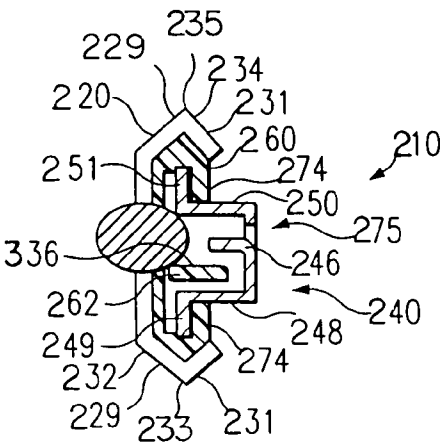
FIG. 31 is a sectional view taken along the line 31—31 of FIG. 30 showing the channel, carriage, stop, rail, tab, and the flexible finger in the second, flexed position.
Figure 29:
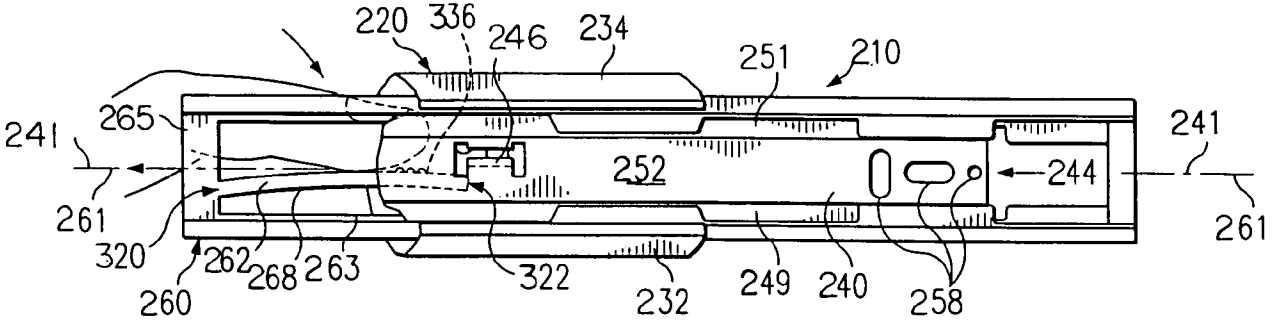
FIG. 29 is a partial overhead plan view of the assembly showing the flexible finger moved to a second, flexed position.
Figure 30:
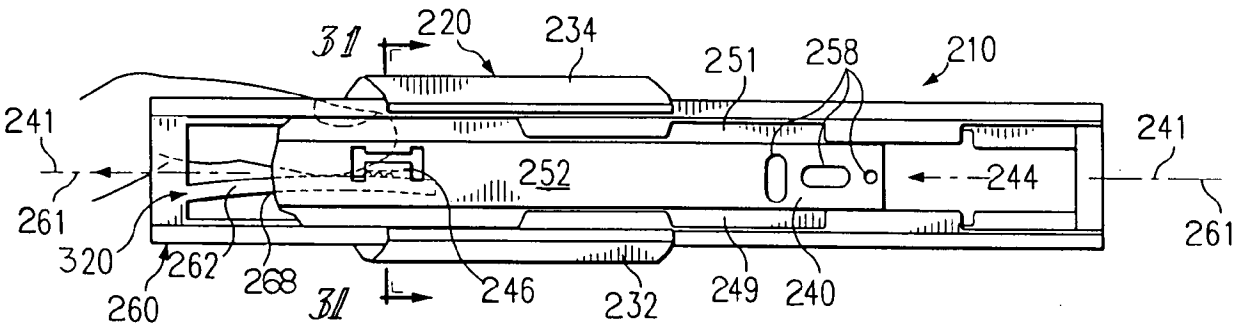
FIG. 30 is a partial overhead plan view of the assembly showing the flexible finger moved to the second, flexed position and the tab moved in a proximal direction beyond the flexible finger.

Referring to FIGS. 21 and 31, channel or outer track 220 is illustrated. Illustratively, channel 220 is formed from a metallic material which is formed and stamped to create the features of channel 220. First side flange 232 and second side flange 234 are spaced-apart with bottom portion 236 extending therebetween. Bottom portion 236 is substantially planar along the length and width of channel 220 to facilitate secure fastening of channel 220 to frame 90. Bottom portion 236 is formed to include attachment holes 237 extending therethrough within which fasteners (not shown) are received for fastening channel 220 to frame 90.

Illustratively, bottom portion 236 of channel 220 is formed to include two upwardly extending outward detents 228 and 230 adjacent first end 222 of channel 220 and an upwardly extending medial detent 226 disposed between outward detents 228 and 230 and second end 224. Illustratively, detents 226, 228, 230 are stamped in bottom portion 220. Outward detents 228, 230 incline rearwardly while medial detent 226 inclines forwardly.

In the illustrated embodiment, the metallic material of channel 220 is bent to form first side flange 232 and second side flange 234. As shown in FIG. 31, first and second side flanges 232 and 234, respectively, include a first portion 229 extending laterally outwardly and upwardly (assuming channel 220 is mounted to an upwardly facing surface of frame 90) from side edges of bottom portion 220 and a second portion 231 extending inwardly and upwardly from first portion 229. As shown for example in FIG. 31, channel has a substantially diamond C-shaped cross-section.

Slide member, inner track, or rail 240 has a first end 242, a second end 244, a top portion 252, a first side wall 248, a second side wall 250, and outwardly extending lips 249 and 251. First side wall 248 and second side wall 250 are spaced-apart with top portion 252 extending therebetween. Illustratively, top portion 252 is substantially planar to facilitate attachment of rail 240 to the underside of bottom panel 81 of drawer 80. First end 242 of rail 240 is attached to an outward, proximal portion 82 of drawer 80 and second end 244 of rail 240 is attached to an inward, distal portion 84 of drawer 80. Carriage 260, also shown in FIGS. 22 and 23, is disposed within the channel 220 and is longitudinally moveable therein.

A lip 249, 251 extends outwardly from the bottom end of each of first and second walls 248 and 250, respectively. Rail 240 is substantially symmetrical about its longitudinal axis 241. Top portion 252 is formed to include attachment holes 258 through which fasteners (not shown) extend to attach rail 240 to drawer 80. As shown in FIG. 31, rail 240 has a substantially box U-shaped or box Ω-shaped cross section. Like channel 220, rail 240 is illustratively formed of a metallic material to facilitate forming of part through standard stamping, cutting and bending operations. Those skilled in the art will recognize that rail 240 and channel 220 can be made from non-metallic materials within the scope of the invention.

Top portion 252 is formed to include a downwardly projecting tab 246. Illustratively, tab 246 is formed by cutting or stamping a laterally extending strip in top portion 252, cutting strip near second side wall 250 and bending strip near longitudinal axis 241 so that tab 246 extends downwardly adjacent longitudinal axis 241.

Figure 22:
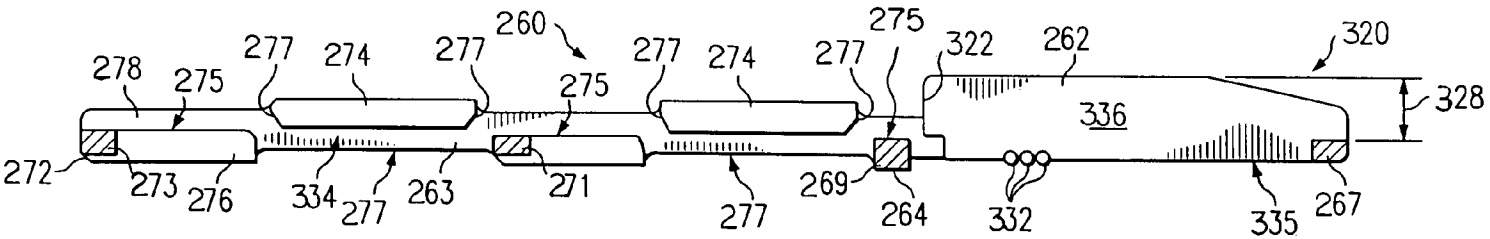
FIG. 22 is a side sectional view along line 22—22 of FIG. 23 of the carriage showing the base, the guides, a stop, and a flexible finger.
Figure 23:
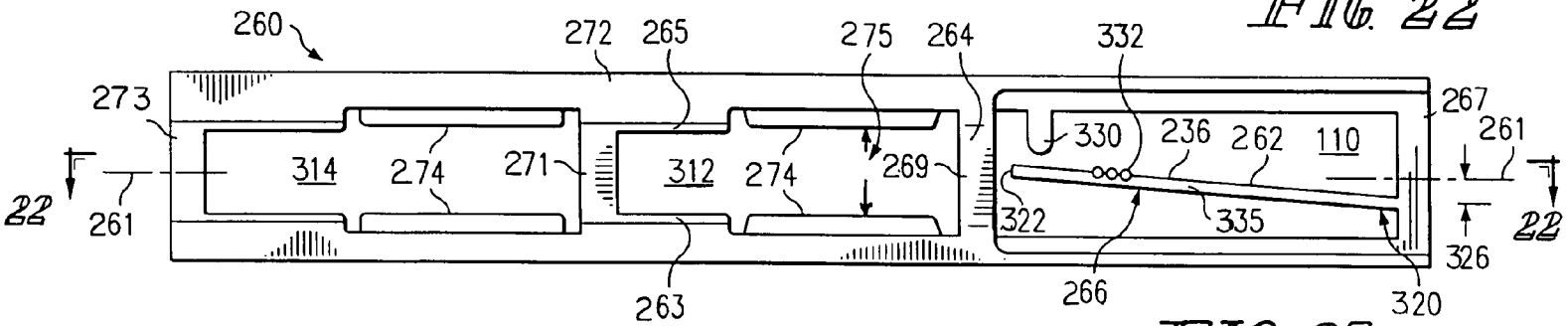
FIG. 23 is a bottom plan view of the carriage.

Referring now to FIGS. 22, 23, and 31 in one embodiment carriage 260 is formed to include a base 272, pairs of guide tabs 274, and a flexible finger 262. Base 272 includes a bottom portion 276, a top portion 278, and a stop 274 projecting from bottom portion 276. Illustratively, bottom portion 276 of base 272 has a top surface 275 and a bottom surface 277 and is formed from longitudinally extending first and second sides 263 and 265, respectively, and cross-members 267, 269, 271, 273. Front cross-member 267, forward middle cross-member 269, first side 263, and second side 265 define a front rectangular opening 310. Forward middle cross-member 269, rearward middle cross-member 271, first side 263, and second side 265 define a middle rectangular opening 312. Rearward middle cross-member 271, rear cross-member 273, first side 263, and second side 265 define a rear rectangular opening 314. Those skilled in the art will recognize that front rectangular opening 310 provides free space within which finger 262 may be flexed and thus the rectangular shape of the opening should not act as a limitation on the scope of the disclosure. Middle and rear rectangular openings 312 and 314, respectively and areas of front rectangular opening 310, serve merely to reduce the material requirements of carriage 260.

Figure 25:
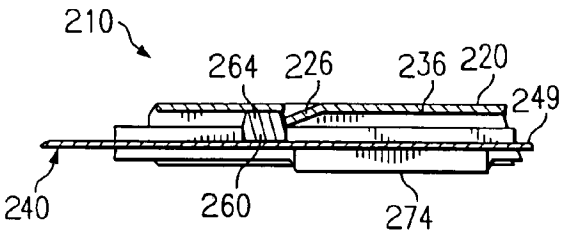
FIG. 25 is a partial sectional view taken along the line 25—25 of FIG. 24 showing a position of the carriage relative to the channel, a tab, and the flexible finger.
Figure 24:
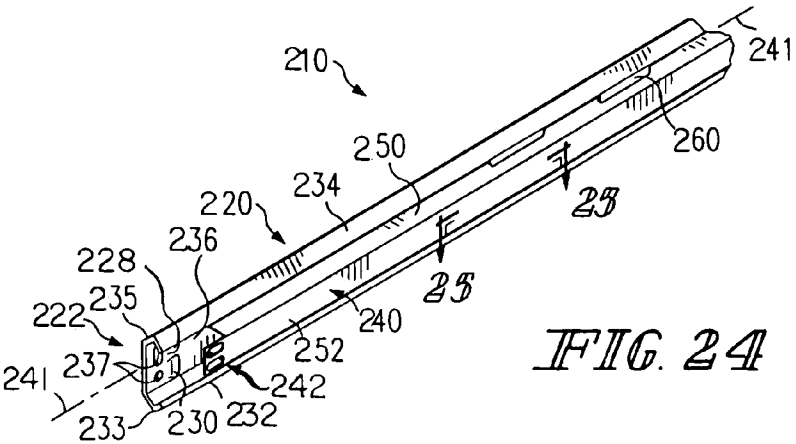
FIG. 24 is a perspective view of the slide assembly in an assembled state showing a relative position of the channel, the carriage, and the rail.
Figure 26:
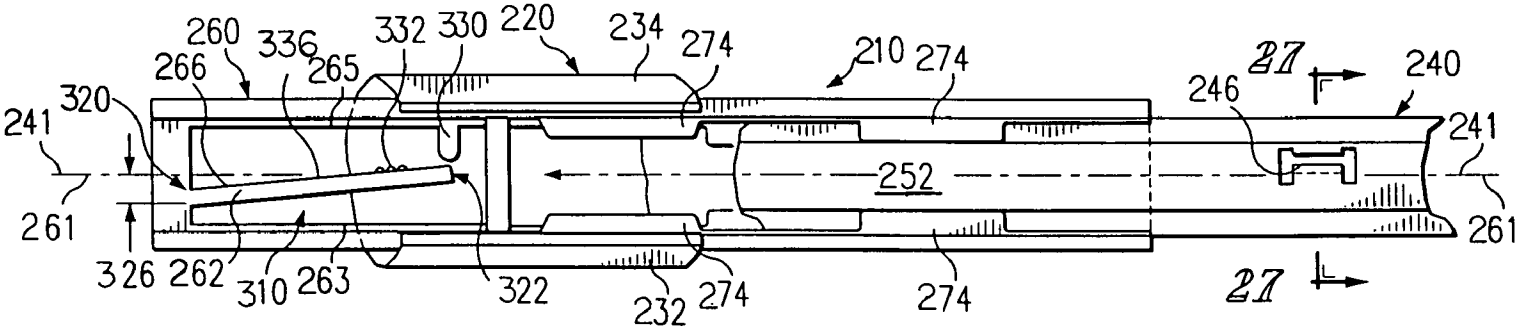
FIG. 26 is a partial overhead plan view of the assembly showing the flexible finger in a first, natural position.
Figure 27:
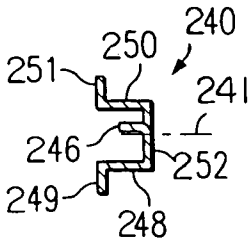
FIG. 27 is a sectional view taken along the line 27—27 of FIG. 26 showing the tab.
Figure 28:
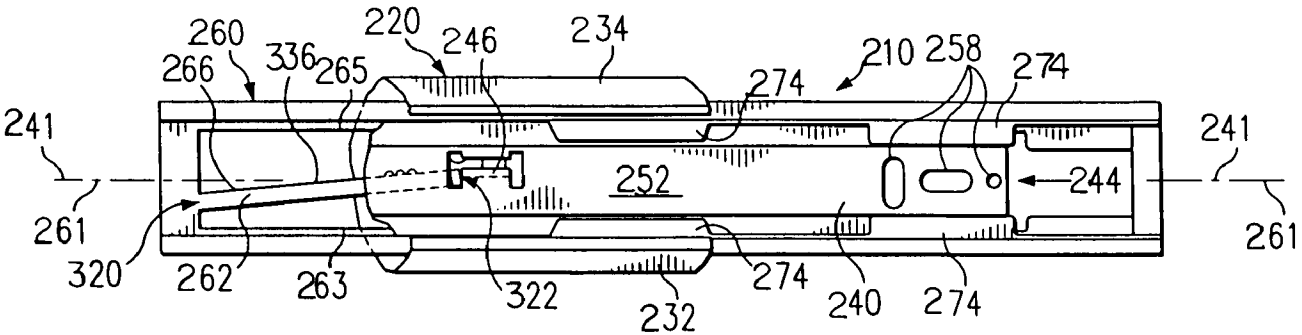
FIG. 28 is a partial overhead plan view of the assembly showing the flexible finger in the first, natural position in contact with the tab.

Base 272 is formed to include a stop 264 projecting downwardly from bottom surface 277 of bottom portion 276. As shown in FIG. 25, Stop 274 is preferably formed to have sharp edges to engage detent 230 to limit the travel of carriage 260 within channel 220. In the illustrated embodiment, stop 264 is a transverse ridge extending downwardly from forward middle cross-member 269.

Top portion 278 extends upwardly from top surface 275 of first and second sides 263 and 265, respectively. Top portion 278 includes a plurality of pairs of guide tabs 274 extending laterally inwardly toward longitudinal axis 261. Each pair of guide tabs 274 are positioned to be in spaced-apart and confronting relationship to one another on opposite sides of the carriage 260 to define a track 275 therebetween within which side walls 248 and 250 and top portion 252 of rail 240 are slidably received for longitudinal movement relative to carriage 260. Outwardly extending lips 249, 251 of rail 240 are slidably disposed within carriage 260 between the bottom surface of associated guide tabs 274 and top surface 277 of sides 263 and 265 of bottom portion 276. The pairs of guide tabs 274 are positioned to define a track 275 for receipt of rail 240.

Carriage 260 is configured to be disposed within channel 220 for longitudinal movement therein. Illustratively, carriage 260 is slidably embraced by angled blades 233 and 235 of side flanges 232 and 234. As shown, for example, in FIG. 31 carriage 260 has a diamond C-shaped cross section facilitating receipt of carriage 260 within channel 220.

In the illustrated embodiment, when carriage 260 is disposed within channel 220, carriage 260 is free to move longitudinally within channel 220 between limits. Stop 264 of carriage 260 and both front detents 230 and 228 of channel 220, upon contact, cooperate to limit the outward movement of carriage 260 relative to channel 220. Those skilled in the art will recognize that outward movement of carriage 260 within channel 220 may be limited by transverse ridge contacting a single front detent or by other properly configured structural elements of carriage 260 and channel 220. Stop 264 of carriage 260 and medial detent 226 of channel 220, upon contact, cooperate to limit inward movement of carriage 260 with respect to channel 220.

As previously stated, carriage 260 is further formed to include flexible finger 262 which cooperates with tab 246 of rail 240 to selectively limit outward movement of rail 240 with respect to carriage 260. Illustratively, flexible finger 262 includes a fixed end 320 and a free end 322. Fixed end 320 is attached to front cross-member 267 so as to be offset from longitudinal axis 261 toward first side 263 by a distance 326 sufficient to allow tab 246 of rail 240 to slide past fixed end 320 without interference from fixed end 320 when rail 240 is inserted into track 275 of carriage 260. Finger 262 extends upwardly from bottom portion 276 a distance 328 sufficient to allow a portion of free end 322 to engage a portion of tab 246. Finger 262 extends longitudinally from fixed end 320 to free end 322 which is displaced toward second end 224 of channel 220 when the carriage 260 is disposed within channel 220. Finger 262 extends laterally inward toward longitudinal axis 261 from fixed end 320 toward free end 322 so that free end 322 is disposed adjacent longitudinal axis 261 when finger 262 is in its natural, first position 266.

Finger 262 is disposed within front rectangular opening 310 to permit finger 262 to be flexed laterally. Illustratively, a stop 330 extends from second side 265 of bottom portion 276 inwardly into front rectangular opening 310 to restrict flexation of finger 262 so that finger 262 can only be flexed toward first side 263. Raised tactile indicators 332 are formed on the bottom 335 and second side 336 of finger 262 to provide a user with a tactile indicator of the side of finger 262 which should be pushed to flex finger 262 toward first side 263 of bottom portion 276.

In the illustrated embodiment, when finger 262 is in the first natural position 266, and rail 240 is slidably received in carriage 260, free end 322 of the finger 262 lies along a common longitudinal axis 241, 261 with tab 246. As rail 240 is moved outwardly with respect to carriage 260, tab 246 engages free end 322 of flexible finger 262 when finger 262 is in the first natural position 266 to limit outward motion of rail 240 with respect to carriage 260. When finger 262 is in flexed position 268, tab 246 moves freely beyond the finger 262 to allow rail 240 to be removed from carriage 260 and thus allow drawer 80 to be removed from frame 90.

In a preferred embodiment, guide tabs 274 include chamfered edges 277. (Best seen in FIG. 2.) Also in a preferred embodiment, carriage 260 is formed from high density polyethylene (HDPE). HDPE is especially suited to this application since it is a relatively inexpensive material, easily formed, durable and self-lubricating in the instant application. However, those skilled in the art will recognize that carriage may be manufactured from other materials within the scope of the invention.

In use, channel 220 is attached to frame 90 by nails, screws, staples, or other suitable fasteners (not shown). Channel 220 is positioned on frame 90 such that detents 226, 228, 230 face upward. Detents 228, and 230 which are formed at the first end 222 of the channel 220, are at the outward, proximal position 92 of the frame 90. In a preferred embodiment, a third detent 226 is formed between first end 222 and second end 224 of channel 220.

In use, rail 240 is attached to drawer 80 by nails, screws, staples, or other suitable means (not shown). Rail 240 is positioned on drawer 80 such that tab 246 faces downward when drawer 80 is in its normal position.

Referring to FIGS. 26–30, carriage 260 is slidably received in channel 220 and rail 240 is slidably received within guide tabs 274. In the preferred embodiment, stop 264 rides up over the inclined portion of detents 228, 230 formed at first end 222 of channel 220. Carriage 260 is slidably and limitedly disposed within the channel 220 to move between an outer limit and an inner limit. When the carriage 260 slides outwardly, stop 264 strikes detents 228, 230 and outward travel of carriage 260 is limited. When carriage 260 slides inwardly, stop 264 strikes detent 226 and the inward travel of the carriage 260 is limited.

To mount the drawer 80 within the frame 90, rail 240 is slidably disposed within track 275 defined by guide tab pairs 274 of carriage 260. As drawer 80 with attached rail 240 is slid into track 275, tab 246 urges flexible finger 262 from its first, natural position 266 to its second, flexed position 268. When finger 262 is in its flexed position 268, finger 262 passes beyond tab 246. After tab 246 passes beyond flexible finger 262, flexible finger 262 returns to its first, natural position 266. It will be appreciated by those skilled in the art, that the placement of detents 226, 228, 230 in combination with the dimensions of carriage 260 and the placement of stop 264 and flexible finger 262 may be designed to control the degree of travel of drawer 80 relative to frame 90.

In operation, assembly 210 provides a smooth mechanism for aligning drawer 80 in frame 90 and maintaining the position of drawer 80 within frame 90. When installed, drawer 80 is constrained from traveling outwardly by contact between flexible finger 262 and tab 246. Conveniently, when it is desirous to remove the drawer 80 from frame 90, manual movement of flexible finger 262 from first, natural position 266 where it is in longitudinal alignment with tab 246 to the second, flexed position 268 where it is not in longitudinal alignment with tab 246 enables drawer 80 to be removed from frame 90.

Those skilled in the art will recognize that during insertion of drawer 80 into frame 90, lips 249, 251 of rail 240 are inserted into a gap 334 between bottom surface of guides 274 and top surface 263 of bottom portion of carriage 260, and rail 240 is slid rearwardly within carriage 260. Initially carriage 260 slides rearwardly within channel until stop 264 engages medial detent 226 while lips 249, 251 of rail 240 slide within guide gaps 334. During insertion of rail 240 into track 275 of carriage 260, tab 246 eventually engages second side 336 of finger between fixed end 320 and free end 322. Upon further insertion, tab 246 urges finger 262 to flex toward first side 263 of carriage 260 until tab 246 passes inwardly beyond free end 322 of flexible finger 262. Upon tab 246 passing inwardly beyond free end 322 of flexible finger 262, flexible finger 262 returns to its natural first position 266.

Although the invention has been described in detail with reference to a certain preferred embodiment, variations and modifications exist within the scope and spirit of the present invention as described and defined in the following claims.

What is claimed is:

1. A slide assembly for a drawer to be received in a frame, the assembly comprising:

a first rail having an outward first end and an inward second end and formed to include a detent;

a second rail having an outward first end and an inward second end and a rigid stop;

a bearing disposed within the first rail, the bearing including a flexible stop, the bearing further including a stop configured to contact the detent whereby the travel of the bearing is limited relative to the first rail; and wherein the second rail is configured to be longitudinally moveably received within the bearing and the flexible stop and rigid stop cooperate to limit the outward travel of the second rail by engagement with one another when the flexible stop is in a first natural position and the second rail is received within the bearing.

2. The slide assembly of claim 1, wherein the second rail is configured to be attached to a bottom panel of the drawer.

3. The slide assembly of claim 2, wherein the first end of the second rail is configured to be attached to an outward, proximal portion of the drawer and the second end of the second rail is configured to be attached to an inward, distal portion of the drawer.

4. The slide assembly of claim 3, wherein the first end of the first rail is configured to be attached to an outward, proximal portion of the frame and the second end of the first rail is configured to be attached to an inward, distal portion of the frame.

5. The slide assembly of claim 1, wherein the second rail is removable from the bearing when the flexible stop is in a second deformed position.

6. The slide assembly of claim 1, wherein the bearing comprises a first side, a second side spaced apart from the first side, a first cross-member extending between the first side and the second side, a second cross-member extending between the first side and the second side and wherein the flexible stop extends from the first cross-member.

7. The slide assembly of claim 6, wherein the flexible stop is in the first, natural position to limit the outward travel of the second rail by contacting the rigid stop and whereby the flexible stop is moveable to a second, flexed position whereby the outward travel of the second rail is not limited.

8. The slide assembly of claim 7, wherein the flexible stop extends between the first and second cross-members.

9. The slide assembly of claim 8, wherein the flexible stop includes an arch-shaped body having a first end attached to the first cross-member and a second end attached to the second cross-member.

10. The slide assembly of claim 6, wherein the bearing comprises a third cross-member extending between the first and second sides and a stiffener attached to the third cross-member.

11. The slide assembly of claim 1, wherein the bearing is high density polyethylene.

12. A slide assembly for a drawer in a frame, the assembly comprising:

a first rail having a first end and a second end, the first rail formed to include a first side flange, a second side flange in spaced-apart relation to the first side flange, and a bottom portion therebetween, the bottom portion including at least one detent;

a second rail having a first end and a second end, the second rail formed to include a first side wall, a second side wall in spaced-apart relation to the first side wall, and a top portion therebetween, the top portion including a rigid stop projecting from the top;

a bearing disposed within the first rail, the bearing including a stop to contact the detent wherein the detent and stop cooperate to limit the outward movement of the bearing relative to the first rail, the bearing including a flexible stop, the bearing being configured to receive the second rail for inward and outward reciprocal movement relative thereto; and whereby when the second rail is disposed within the bearing the flexible stop limits the outward travel of the second rail by contacting the rigid stop.

13. The slide assembly of claim 12, wherein the bearing is embraced by the side flanges.

14. The slide assembly of claim 12, wherein each of the flanges are formed to include an angled blade.

15. The slide assembly of claim 12, wherein each of the side walls of the second rail are formed to include a lip.

16. A slide assembly for a drawer and a frame, the assembly comprising:

a first rail having a first end and a second end, the first rail formed to include a first side flange, a second side flange positioned to lie in spaced-apart relation to the first side flange, and a bottom portion therebetween, each of the flanges formed to include an angled blade, the bottom portion formed to include at least one detent;

a second rail having a first end and a second end, the second rail formed to include a first side wall, a second side wall positioned to lie in spaced-apart relation to the first side wall, and a top portion therebetween, each of the side walls formed to include a lip, the top portion formed to include a rigid stop projecting downward from the top portion;

a bearing formed to be disposed within the first rail, the bearing being embraced by the angled blades, the bearing formed to include a cross-member formed to contact the at least one detent whereby the travel of the bearing is limited, the bearing further formed to include a flexible stop, the bearing being further formed to receive the lips of the second rail; and wherein when the lips are slidably disposed within the bearing the flexible stop limits the travel of the second rail by contacting the rigid stop.

17. The slide assembly of claim 16, wherein the bearing is formed to include a base having a bottom portion and a top portion and at least one pair of clutches appended to the top portion and positioned to be in spaced-apart and confronting relationship to one another on opposite sides of the base and defining a gap therebetween and wherein the second rail is slidably disposed within the gap.

18. The slide assembly of claim 17, wherein each of the clutches includes a front wall and a bottom wall, the bottom portion includes a top surface and the bottom walls of the clutches and top surface of the bottom portion cooperate to form a track configured to slidably receive the lips of the second rail therein.

19. The slide assembly of claim 18, wherein the front wall of each of the clutches is formed to include a compound angle to funnel the lips of the second rail into the track.

20. The slide assembly of claim 16, wherein the flexible stop has a first position and at least one flexed position and whereby when the flexible stop is in its first position, the flexible stop engages the rigid stop during outward movement of the second rail and whereby when the flexible stop is in the flexed position the rigid stop moves freely beyond the flexible stop.

* * * * *